United States Patent [19]

Yamagata et al.

[11] 4,453,053

[45] Jun. 5, 1984

[54] CIRCUIT BREAKER WITH ARC RESTRICTING DEVICE

[75] Inventors: Shinji Yamagata, Fukuyama; Fumiyuki Hisatsune, Fukuyama; Junichi Terachi, Fukuyama; Hajimu Yoshiyasu, Itami, all of Japan

[73] Assignee: Mitsubishi Denki Kabushiki Kaisha, Tokyo, Japan

[21] Appl. No.: 381,910

[22] Filed: May 25, 1982

[30] Foreign Application Priority Data

| | | | |
|---|---|---|---|
| Jul. 21, 1981 | [JP] | Japan | 56-109071[U] |
| Aug. 25, 1981 | [JP] | Japan | 56-126276[U] |
| Aug. 25, 1981 | [JP] | Japan | 56-126280[U] |
| Aug. 27, 1981 | [JP] | Japan | 56-127735[U] |
| Aug. 27, 1981 | [JP] | Japan | 56-127736[U] |

[51] Int. Cl.[3] ..... H01H 9/30

[52] U.S. Cl. ..... 200/144 R; 335/201

[58] Field of Search ..... 200/144 R, 304; 335/201

[56] References Cited

U.S. PATENT DOCUMENTS

| | | | |
|---|---|---|---|
| 2,134,565 | 10/1938 | Leonard | 200/144 R |
| 3,402,273 | 9/1968 | Davis | 200/144 R |
| 3,599,130 | 8/1971 | Murai | 335/174 X |

FOREIGN PATENT DOCUMENTS 1765051 7/1971 Fed. Rep. of Germany .

*Primary Examiner*—E. A. Goldberg
*Assistant Examiner*—Morris Ginsburg
*Attorney, Agent, or Firm*—Wenderoth, Lind & Ponack

[57] ABSTRACT

The present invention relates to a circuit breaker comprising a pair of contactors each comprising a rigid conductor with a contact secured thereon, wherein at least one of the contactors is also provided with an electrically conductive projection secured on the rigid conductor in proximity to the contact, the contact and the projection having their peripheries surrounded by a high resistivity arc shield of a resistivity higher than the rigid conductors. An arc extinguishing plate assembly is also provided to cool and extinguish an arc drawn across the gap between the contacts. With this arrangement, the arc is confined and has its voltage raised by the effects of the arc shield, and the size of the foot of the arc is limited such that it does not spread to the surface of the conductor in the vicinity of the contact. Further, the foot of the arc is caused to shift from the contact to the projection, substantially preventing wear of the contact and further extending the length of the arc to more effectively cool and extinguish the arc.

9 Claims, 25 Drawing Figures

CIRCUIT BREAKER WITH ARC RESTRICTING DEVICE

BACKGROUND OF THE INVENTION

This invention relates to circuit breakers, and in particular provides a circuit breaker constructed such that the arc voltage of an arc drawn across the gap between a pair of contacts is effectively raised, and such that the foot of the arc is caused to shift to an electrically conductive projection provided in proximity to the contact to increase the length of the arc to effectively extinguish the arc.

In prior circuit breakers, the foot of an arc drawn across the gap between the contacts would spread onto the surfaces of the conductor in the vicinity of the contact, making it impossible to increase the arc voltage to any great extent, and also resulting in the defect that since the foot of the arc generally remained on the contact, wear of the contact was apt to occur.

SUMMARY OF THE INVENTION

The present invention provides a circuit breaker wherein a contact and a projection are provided on the rigid conductor of a contactor and an arc shield is provided surrounding the peripheries of the contact and the projection. By this means, an arc drawn across the gap between the contacts is constricted, the arc voltage is greatly raised and the spread of the foot of the arc to the surface of the rigid conductor in the vicinity of the contact is limited. Further, the foot of the arc is moved from the contact to the projection whereby wear of the contact is substantially prevented, and the length of the arc is extended, effectively cooling the arc for extinction.

BRIEF DESCRIPTION OF THE DRAWINGS

FIG. 1(*b*) is a sectional side view of the circuit breaker of FIG. 1(*a*) taken along the line b—b in FIG. 1(*a*);

FIG. 3(*b*) is a sectional side view of the circuit breaker of FIG. 3(*a*) taken along the line b—b in FIG. 3(*a*);

FIG. 4(*b*) is an exploded perspective view of the stationary contactor portion of the circuit breaker of FIG. 3(*a*);

FIG. 6(*b*) is an exploded perspective view of a movable contactor portion employing an embodiment of an arc shield different from that shown in FIG. 4(*b*);

FIG. 10(*b*) is an exploded perspective view of the movable contactor portion of the circuit breaker of FIG. 9;

FIG. 11(*b*) is an exploded perspective view of a movable contactor portion employing an embodiment of an arc shield different from that shown in FIG. 10(*b*);

FIG. 13(*b*) is a side view of the stationary contactor portion shown in FIG. 12;

FIG. 14(*b*) is a plan view of the arc shield shown in FIG. 14(*a*);

FIG. 15(*b*) is a sectional side view of the circuit breaker of FIG. 15(*a*) taken along the line b—b in FIG. 15(*a*)

In the figures, like references or numeral denote like or corresponding parts.

DESCRIPTION OF THE PREFERRED EMBODIMENTS

Figure 1A:
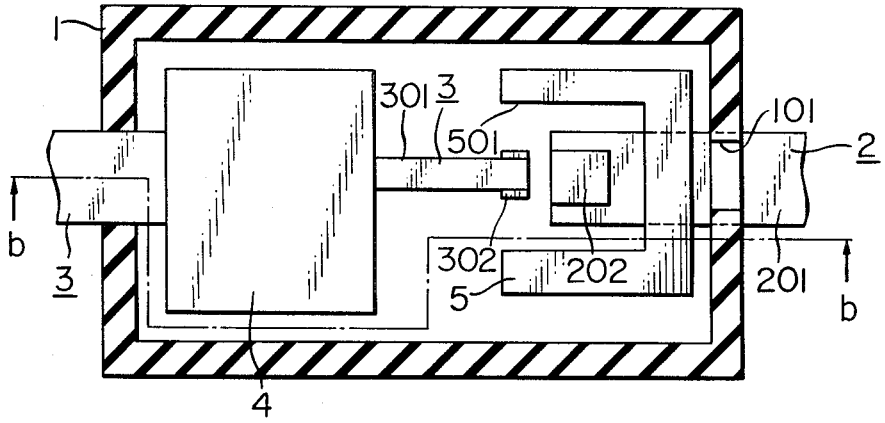
FIG. 1a (PRIOR ART)
FIG. 1(*a*) is a sectional plan view of a conventional circuit breaker to which the present invention may be applied.
Figure 1B:
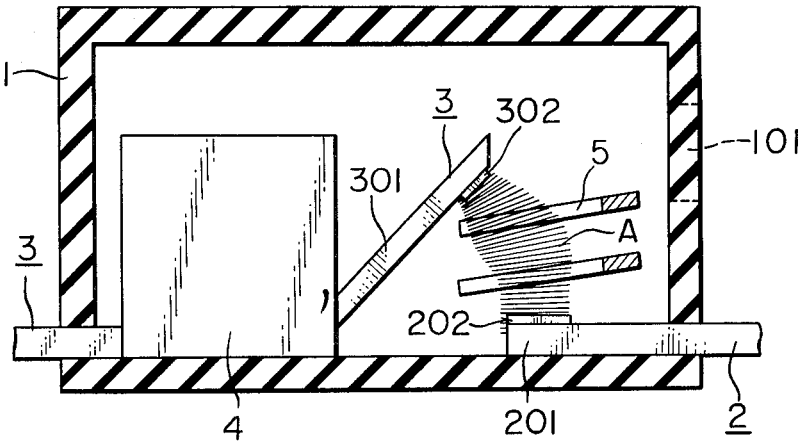
FIG. 1b (PRIOR ART)

A conventional circuit breaker to which the present invention can be applied is shown in FIGS. 1(*a*) and 1(*b*).

An enclosure 1 is made of insulating material, forming the housing for a circuit breaker, which comprises a pair of electrical contactors 2 and 3, which are respectively a stationary contactor and a movable contactor. On an electrical contacting surface of a stationary rigid conductor 201, which forms the main part of the stationary contactor 2, is affixed a stationary-conductor contact 202, and on an electrical contacting surface of a movable rigid conductor 301, which forms the main part of the movable contactor 3, is affixed a movable-conductor contact 302, which opens and closes with the stationary-conductor contact 202. An operating mechanism 4 operates to open or close the circuit breaker by moving the movable contactor 3 in or out of contact with the stationary contactor 2. An arc-extinguishing plate assembly 5 is provided in the arc space between the stationary-conductor contact 202 and the movable-contactor contact 302, and has cut-out slits 501 in the plates, the slits 501 being open-ended on the side toward the stationary-contactor contact 202 and the movable-contactor contact 302. The operating mechanism 4 and the arc-extinguishing plate assembly 5 are well known in the art, and are described, for example, in U.S. Pat. No. 3,599,130, "Circuit Interruptor", issued to W. Murai et al., Aug. 10, 1971. As apparent from the named patent, the operating mechanism includes a reset mechanism. An exhaust port 101 is formed in the enclosure 1.

In FIGS. 1(*a*) and (*b*), when the movable-contactor contact 302 and the stationary-contactor contact 202 are in contact, current flows from a power supply side onto a load side along a path from the stationary rigid conductor 201 to the stationary-contactor contact 202 to the movable-contactor contact 302 to the movable rigid contactor 301. When, in this state, an over-current such as a short-circuit current flows through the circuit, the operating mechanism 4 operates to separate the movable-contactor contact 302 from the stationary-contactor contact 202. At this time, an arc A appears across the gap between the stationary-contactor contact 202 and the movable-contactor contact 302, and an arc voltage develops thereacross. The arc voltage rises as the distance of separation between the movable-contactor contact 302 from the stationary-contactor contact 202 increases. In addition, at the same time, the arc A is drawn by the magnetic force of attraction in the direction of the arc-extinguishing plate assembly 5, and the arc-extinguishing plates cause the arc to be stretched, thus further raising the arc voltage. In this way, the arc current reaches the current zero point, the arc A is extinguished, and the interruption is completed.

During the interrupting operation thus far described, large quantities of energy are generated across the gap between the movable-contactor contact 302 and the stationary-contactor contact 202 in a short space of time of the order of several milliseconds, by the arc A. In consequence, the temperature of the gas within the enclosure 1 rises abruptly, as does the pressure thereof, and the high temperature and pressure gas is emitted into the atmosphere through the exhaust port 101.

The circuit breaker performs the interrupting operation as described above to interrupt overcurrents.

Explanation is now made with regard to the behaviour of the arc voltage, etc., across the stationary-contactor and movable-contactor contacts 202 and 302 of the circuit breaker shown in FIGS. 1(*a*) and (*b*).

In general, the arc resistance R (Ω) is given by the following expression:

$$R=\rho(l/S)$$

where $\rho$: arc resistivity (Ω.cm)

l: arc length (cm)

S: arc sectional area ($cm^2$)

In general, in a short arc A which has a high current of at least several kA and an arc length of at most 50 mm, the arc space is occupied by metal particles emitted from the conductors on which the ends of the arc are located. The emission of metal particles from the rigid conductors occurs orthogonally to the surfaces of the rigid conductors, and at the time of the emission, the emitted particles have a temperature close to the boiling point of the metal of the rigid conductors. Further, whether or not they are injected into the arc space, they are injected with electrical energy, rising in temperature and pressure, and taking on conductivity, and they flow out of the arc space at high speed in a direction away from the conductors while diverging in a direction according to the pressure distribution in the arc space. Thus, the arc resistivity $\rho$ and the arc sectional area S in the arc space are determined by the quantity of contact particles produced and the direction of emission thereof. Accordingly, the arc voltage is also determined by the behaviour of such contact particles.

Figure 2:
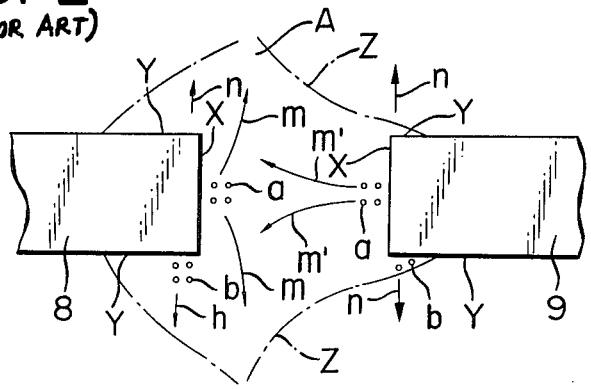
FIG. 2 (PRIOR ART)
FIG. 2 is a diagram for showing the behaviour of an arc drawn across the gap between the contacts of the circuit breaker of FIG. 1(*a*)

The behaviour of such electrode particles is explained in conjunction with FIG. 2.

In FIG. 2, a pair of conductors 8 and 9 are ordinary conductors in the form of a pair of mutually opposed metallic members, the conductor 8 being an anode, and the conductor 9 being a cathode. Also the surfaces X of the respective conductors 8 and 9 are opposing surfaces which become contact surfaces when the conductors 8 and 9 come into contact, and the surfaces Y of the respective conductors 8 and 9 indicate the electrically contacting surfaces of the conductors other than the surfaces X, the respective opposing contact surfaces. There is no change in the behaviour of the metal particles as described below even when the surfaces X are constructed of the contact members. The contour Z indicated by a dot-and-dash line in the figure indicates the envelope of the arc A struck across the conductors 8 and 9, and further, the metal particles a and metal particles b illustrate in model form the metal particles which are respectively emitted from the surfaces X and Y of the conductors 8 and 9 by vaporization etc, and the directions of emission thereof are respectively the directions of the flow lines indicated by arrows m, m′ and n.

Such metal particles a and b emitted from the conductors 8 and 9 have their temperature raised by the energy of the arc space, from approximately 3,000° C., the boiling point of the metal of the conductors, to a temperature at which the metal particles take on conductivity, i.e., at least 8,000° C., or to the even higher temperature of approximately 20,000° C. and by the process of the temperature rising, they take energy out of the arc space and lower the temperature of the arc space, the result of which is to increase the arc resistance R. The quantity of energy taken from the arc space by the metal particles a and b increases with the extent of rise in the temperature of the metal particles, and the degree of rise in temperature is determined by the positions in the arc space and the emission paths of the metal particles a and b emitted from the conductors 8 and 9.

Further, the paths of the metal particles a and b emitted from the conductors 8 and 9 are determined by the pressure distribution in the arc space.

The pressure in the arc space is determined by the interrelationship between the pinch force of the current itself and the thermal expansion of the metal particles a and b. The pinch force is a quantity which is substantially determined by the density of the current, or in other words, it is determined by the size of the foot of the arc A on the conductors 8 and 9. In general, the metal particles a and b may be considered to fly in the space determined by the pinch force while thermally expanding.

It is also known that, in a case where the foot of the arc A on the conductors 8 and 9 is not limited, the metal particles a blow unidirectionally from one conductor 9 to the other conductor 8 in the form of a vapor jet. When, in this manner, the metal particles a blow unidirectionally from one conductor 9 toward the other conductor 8, the metal particles a injected into the positive column of the arc A are supplied substantially from only the conductor 9 on one side. FIG. 2 illustrates by way of example a case where the metal particles blow strongly from the cathode to the anode, but blowing in the opposite direction may also occur.

The above situation will now be explained more fully. In FIG. 2, it is supposed that the blowing, for whatever reason, is unidirectional from the conductor 9 toward the conductor 8. The metal particles a emitted from the surface X which is the opposing contact surface of the conductor 9 tend to fly orthogonally to the conductor surface in other words, toward the positive column. At this time, metal particles a emitted from the contact surface X of one conductor 9 are injected into the positive column by pressure produced by the pinch force. Metal particles a emitted from the surface X of the other conductor 8 are pushed by the particle stream in the positive column and are ejected in the direction outside the surface X, instantly escaping from the system without entering the positive column. In this manner, the movements of the metal particles a emitted from the conductor 8 and of the metal particles a emitted from the conductor 9 are different, as indicated by the flow lines of the arrows m and m' in FIG. 2, because, as stated before, of the difference between the pressures produced by the pinch forces at the conductor surfaces. Thus, the unidirectional blowing from the rigid conductor 9 heats the rigid conductor 8 on the side toward which the particles are blown causing the foot (anode spot, cathode spot) of the arc on the surface of the conductor 8 to expand from the front surface X thereof to the other surfaces thereof. In consequence, the current density on the surface of the conductor 8 falls, and the pressure of the arc also falls. Accordingly, the unidirectional blowing from the conductor 9 becomes increasingly strong. The discrepancy in the flight paths of the metal particles a emitted from the respective conductors 8 and 9 thus produced results in a discrepancy in the quantitites of energy taken from the arc space. Accordingly, the metal particles a emitted from the surface X of the conductor 9 are able to absorb substantial energy from the positive column, but the metal particles a emitted from the surface X of the conductor 8 are not able to absorb substantial energy, and so they are ejected out of the system without effectively cooling the arc A. Also the metal particles b emitted from the surfaces Y of the conductors 8 and 9 spread, as in the flow lines shown by the arrows n in the figure, and not only do they not take substantial heat from the arc A, but they increase the arc sectional area S, and lower the arc resistance R of the arc A.

In this manner, because of blowing from one conductor 9, the efficiency of the cooling of the positive column by the metal particles a deteriorates, and also the metal particles b produced from the surfaces Y of both the conductors 8 and 9, which are those surfaces other than the opposing surfaces, do not contribute to the cooling of the positive column at all and may even lower the arc resistance R by increasing the arc sectional area S. Accordingly, the presence of the unidirectional blowing of the metal particles from one conductor to the other conductor is impedimental to raising the arc voltage and consequently it is impossible to enhance the current-limiting performance during breaking.

There is the disadvantage that the stationary contactor and the movable contactor generally used in conventional circuit breakers have large surface areas, on the opposing surfaces similar to the conductors of the model of FIG. 2, and accordingly not only is it impossible to limit the size of the foot of the arc produced, but they have exposed surfaces such as the side surfaces other than the opposing surfaces, so that, as explained with reference to FIG. 2, the position and size of the feet(anode spot or cathode spot) of the arc produced on the surfaces of the two conductors cannot be particularly limited, and so with the mechanism explained with regard to FIG. 2, the unidirectional blowing of the metal particles a from one conductor to the other conductor occurs, and so the arc sectional area increases, and as stated above the current-limiting performance during breaking cannot be enhanced.

Further, a major drawback of prior contactors is the danger that because of the spread of the foot of the arc to the Y surfaces, the foot of the arc is liable to spread directly to the joint between the contact and the conductor which is often set on the surface Y, and a joint member with a low fusing point may be melted by this heat, causing the contact to fall off.

The circuit breaker according to the present invention eliminates the abovementioned drawbacks and defects, and comprises in the construction thereof, a projection of a material having a conductivity substantially the same as the rigid conductor secured to the rigid conductor of at least one of a pair of electrical contactors, each contactor comprising a rigid conductor and a contact secured to the rigid conductor, and an arc shield of a high resistivity material of a higher resistivity than the rigid conductor disposed on the rigid conductor of the aforementioned contactor in such a manner as to surround the periphery of the contact, and, when the projection is provided, the periphery of the projection. The aforementioned arc shield constitutes an arc restricting device to be discussed hereinbelow.

As the above mentioned high resistivity material for the arc shields, for example, an organic or inorganic insulator, or high resistivity metals such as copper-nickel, copper-manganese, manganin, iron-carbon, iron-nickel, nickel, or iron-chromium, etc, may be used. It is also possible to use iron the resistivity of which increases abruptly with temperature rise.

Next, an embodiment of the present invention will be described in connection with FIG. 3(*a*), 3(*b*), 4(*a*) and 4(*b*).

Figure 3A:
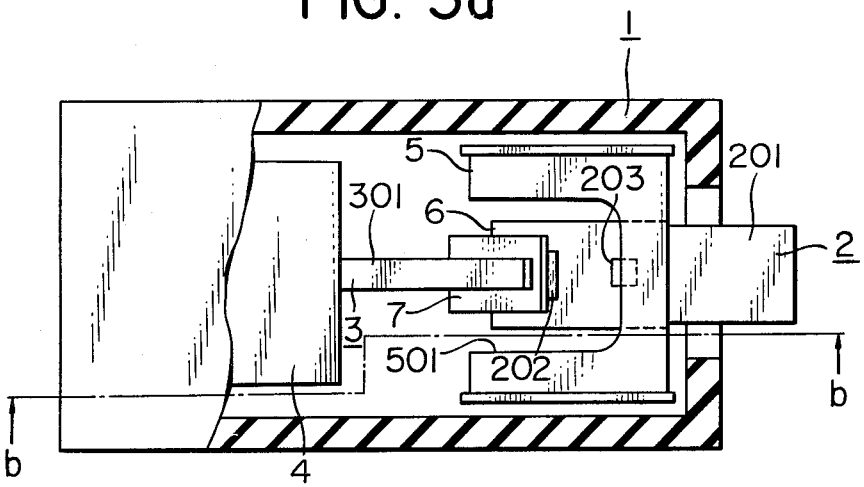
FIG. 3(*a*) is a sectional plan view showing an embodiment of a circuit breaker according to the present invention.
Figure 3B:
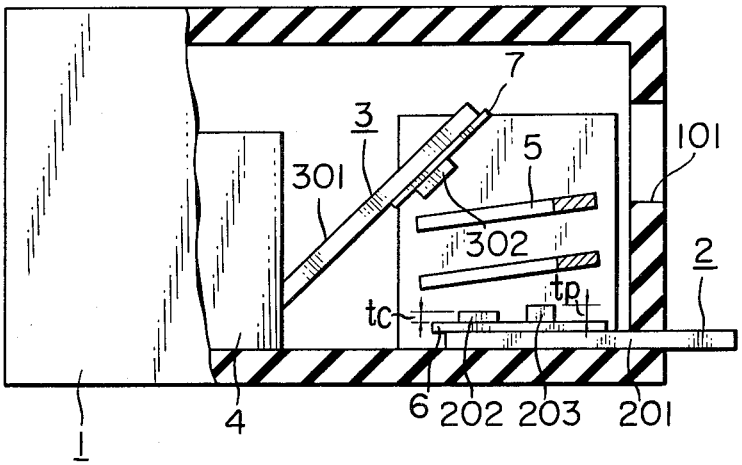
Figure 4A:
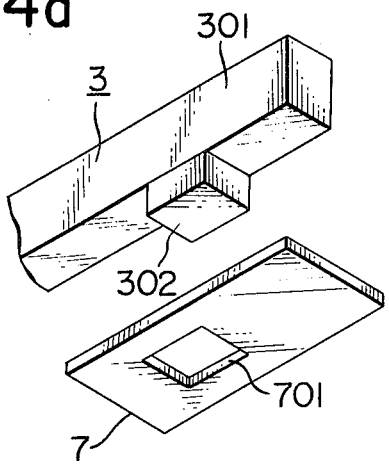
FIG. 4(*a*) is an exploded perspective view of the movable contactor portion of the circuit breaker of FIG. 3(*a*)
Figure 4B:
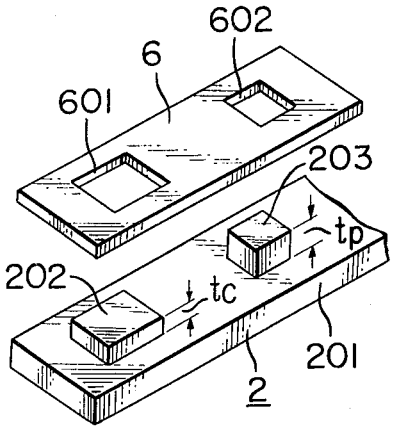

In FIGS. 3(*a*) and 3(*b*), an enclosure 1 of an insulating material forms the housing for a circuit breaker, and is provided with a gas exhaust port 101. The circuit breaker comprises a pair of electrical contactors 2 and 3, which are respectively a stationary contactor and movable contactor. On an electrical contacting surface of a stationary rigid conductor 201, which forms the main part of the stationary contactor 2, is affixed a stationary-contactor contact 202, and on an electrical contacting surface of a movable rigid conductor 301, which forms the main part of the movable contactor 3, is affixed a movable-contactor contact 302. An operating mechanism 4 operates to open or close the circuit breaker by moving the movable contactor 3 in or out of contact with the stationary contactor 2. An arc-extinguishing plate assembly 5 is provided in the arc space between the stationary-contactor contact 202 and the movable-contactor contact 302. The arc extinguishing plate assembly 5 has cut-out slits 501 in the plates, the slits being open ended toward the stationary-contactor contact 202 and the movable-contactor contact 302. Also, to the stationary contactor 2 and the movable contactor 3 are respectively affixed arc shields 6 and 7. As is clear from FIG. 4(*b*), the arc shield 6 affixed to the stationary contactor 2 has two through-holes 601 and 602, and through one of such through-holes 601 passes the aforementioned stationary-contactor contact 202. Further, as is clear from FIG. 4(*a*), the arc shield 7 affixed to the movable contactor 3 also has a through-hole 701, through which passes the aforementioned movable-contactor contact 302. The arc shields 6 and 7 are made of a high resistivity material of a higher resistivity than the above described rigid conductors 201 and 301. With this construction, the respective contacts 202 and 302 of the contactors 2 and 3 have their peripheries surrounded by the respective arc shields 6 and 7, and the portions of the rigid conductors around the contacts are covered by the arc shields 6 and 7. In this embodiment, an electrically conductive projection 203 is provided in proximity to the contact 202 of the stationary contactor, and this projection 203 passes through the other through-hole 602 in the arc shield 6 to project thereabove. In the illustrated embodiment, the height (tp) of the projection 203 is limited in such a way as to not impede the opening and closing of the contacts 202 and 302, but is greater than the height (tc) of the stationary contact 202. That is to say $tc<tp$.

Figure 5:
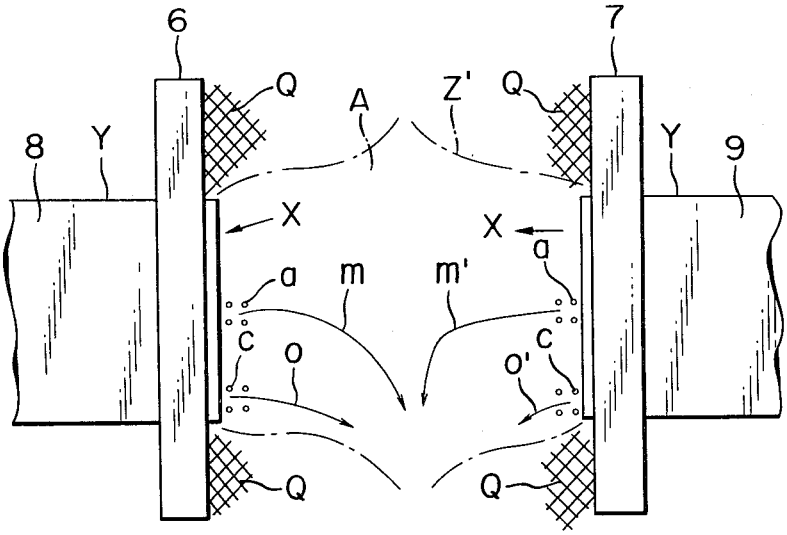
FIG. 5 is a diagram for showing the behaviour of an arc in the circuit breaker of FIG. 3(*a*)

Next, the effect of the arc shields of the abovedescribed embodiment will be explained with reference to FIG. 5. In FIG. 5, the pair of rigid conductors 8 and 9 is constructed in the same form as those of FIG. 2, and a pair of arc shields 6 and 7 are respectively mounted on the rigid conductors 8 and 9, with the surfaces X, the opposing surfaces of the rigid conductors 8 and 9, being disposed so as to protrude from the shields, and sited in a manner to oppose the electric arc A. Of course, the metal particle behaviour to be described below is similar even when the surfaces X are formed from the contact members themselves. That is to say, the pressure values in the spaces Q cannot exceed the pressure value of the space of the arc A itself. However, much higher values are exhibited, at least in comparison with the values attained without the arc shields 6 and 7. Accordingly, the peripheral spaces Q which have the relatively high pressures caused by the arc shields 6 and 7 generate forces that suppress the spread of the space of the arc A and confine the arc A to a small area. This results in confining the flow lines m, m', o and o' of metal particles a and c emitted from the surfaces X, the opposing surfaces, into the arc space. As a result, large quantities of metal particles a and c emitted from surfaces X are effectively injected into the arc space and take large quantities of energy from the arc space, thus markedly cooling the arc space. Accordingly, the resistivity $\rho$, i.e. the arc resistance R is significantly raised, as is the arc voltage.

Further, when the arc shields 6 and 7 are disposed near and around the contact surfaces of the stationary-contactor contact and the movable-contactor contact, namely, the surfaces X, the opposing surfaces shown in FIG. 5, the arc A is prevented from moving to the surfaces Y, the other surfaces of the conductor, and also the size of the foot of the arc A is limited. Thus, the emission of the metal particles a and c is concentrated on the surfaces X, and the arc sectional area is contracted, so that the effective injection of the metal particles a and c into the arc space is further promoted. Accordingly, the cooling of the arc space, the rise of the arc resistivity $\rho$ and the rise of the arc resistance R are further improved, and the arc voltage can be further raised.

Next, the above described effects will be explained with respect to the embodiment of FIGS. 3(*a*) and 3(*b*). When the movable-contactor contact 302 separates from the stationary-contactor contact 202 an arc A is struck across the gap between the movable-contactor contact 302 and the stationary-contactor contact 202.

The arc A, for reasons to be given below, shifts its foot (spot) from the stationary-side contact 202 to the projection 203. That is to say, because of the facts that the arc voltage between stationary-contactor contact 202 and the movable-contactor contact 302 is greatly raised by the effect of the arc shields 6 and 7, as explained above, and the projection 203 is at the same electrical potential as the stationary-contactor contact 202 and extends higher than the stationary-contactor contact into the high temperature, high pressure gas due to the arc A, a dielectric breakdown occurs between the movable-contactor contact 302 and the projection 203, and the foot of the arc A on the stationary-contactor contact 202 shifts to the projection 203. Thus wear of the stationary-contactor contact 202 is kept to a minimum. Further, the arc shields 6 and 7 surrounding the peripheries of the respective contacts 202 and 302 function as arc restricting devices, so the foot of the arc A does not form in the joining surfaces of the contacts, and, in addition, the foot of the arc A shifts, so Joule heat generation at the contacts is reduced, whereby dislodging of the contact is substantially prevented. Also, the height of the projection 203 (tp) in the present embodiment is greater than the height of the stationary-contactor contact 202 (tc), and so even with repeated shifting of the arc A through a large number of interruption operations, the projection 203 is not easily worn or reduced. That is to say, any reduction of reliability caused by wear of the projection 203 due to frequent interruptions, is substantially prevented. Naturally, in this case too, the arc A shifted to the projection 203, is subject to the confining effect for the above described reasons, and the current limiting continues.

The arc extinguishing plates of the arc extinguishing plate assembly 5 may be made either of a magnetic material or a non-magnetic material. When they are made of a magnetic material, the arc is effectively cooled, but in a circuit breaker of a large rated current, a problem is created by a temperature rise during rated operation due to eddy currents produced by the magnetic material. On the other hand, where they are constructed of a non-magnetic material, the arc cooling effect is slightly inferior, but there is no problem due to a temperature rise during rated operation.

In this embodiment, the provision of a projection 203 in association with the stationary contactor 2 only has been discussed, but the invention is not limited to this, and may equally relate to the provision of a projection in association with the movable contactor 3 only, or in association with both contactors 2 and 3, with similar effects being achieved in each case. In the case of providing projections in association with both the contactors 2 and 3, in particular, there is the benefit that wear of both the contacts 202 and 302 is further reduced. The foregoing is discussed further hereinbelow with relation to certain specific embodiments of the present invention.

Figure 6B:
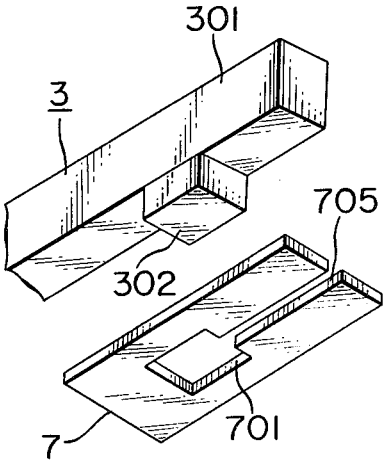
FIG. 6(*a*) is an exploded perspective view of a stationary contactor portion employing an embodiment of an arc shield different from that shown in FIG. 4(*a*)
Figure 6A:
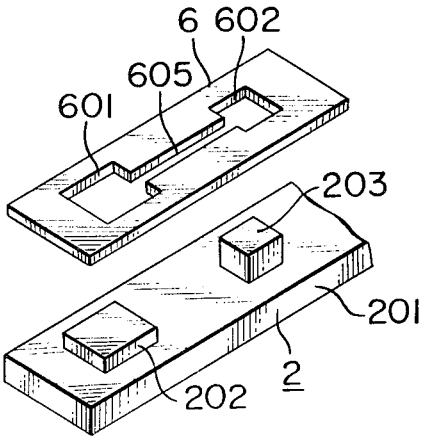

Next, an embodiment will described in relation to FIGS. 6(*a*) and 6(*b*), wherein a slit 605 is provided in the arc shield 6 to expose the surface of the stationary rigid conductor 201 between the stationary-contactor contact 202 and the projection 203, and a slit 705 is provided in the arc shield 7 to expose the surface of the movable rigid conductor 301, extending from a side surface of the movable-contactor contact 302 in a direction away from the movable-contactor contact 302, i.e. the direction of travel of the arc A. The exposure of the movable rigid conductor 301 by the slit 705 makes it easier to cause the arc to shift to the projection 203. This point is common to each of the embodiments below.

Figure 7:
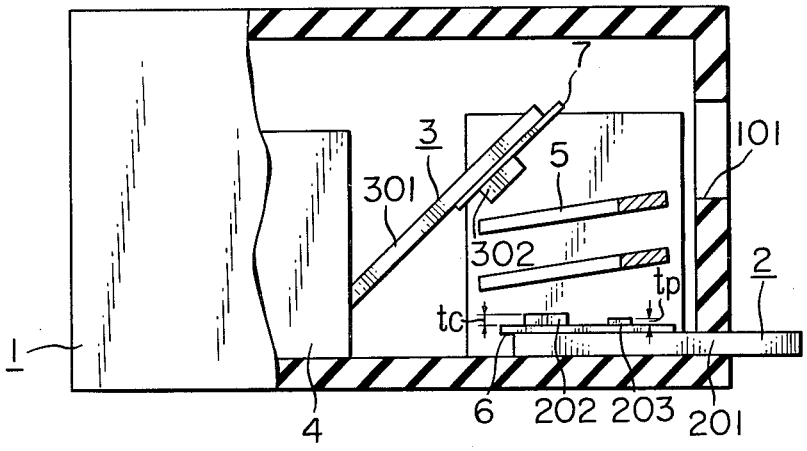
FIG. 7 is a sectional plan view showing another embodiment of a circuit breaker according to this invention.
Figure 8:
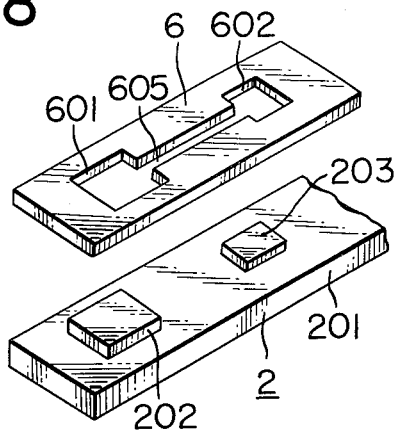
FIG. 8 is an exploded perspective view of the stationary contactor portion of the circuit breaker of FIG. 7.

FIG. 7 shows another embodiment of the present invention wherein all parts and the construction thereof, with the exception of the projection 203, are substantially similar to the corresponding parts and construction of the embodiment shown in FIGS. 3(*a*) and 3(*b*). That is to say, the peripheries of the respective contacts 202 and 302 of the contactors 2 and 3 are respectively surrounded by the arc shields 6 and 7, and so the rigid conductors in those region are covered by the arc shields 6 and 7. As shown in FIG. 7, an electrically conductive projection 203 is provided in proximity to the contact 202 of the stationary contactor 2 on the side of the direction in which the arc flows, i.e. the side of the arc extinguishing plates assembly 5, the projection 203 passing through another through-hole 602 to project above the arc shield 6. In this embodiment, the height of the projection (tp) is made to be the same as or lower than the height (tc) of the stationary-contactor contact 202 of the stationary contactor 2 on which the projection 203 is provided. That is to say, $tc \geqq tp$. The basic operation of the circuit breaker of this embodiment is the same as that of the embodiment shown in FIGS. 3(*a*) and 3(*b*), and so a description thereof is omitted. However, in this embodiment, the height of the projection 203 is lower than or equal to the height of the face of the stationary-side contact 202, and so the length of the arc A increases due to the geometric relationship of the relevant parts, when the foot of the arc A shifts from the stationary-contactor contact 202 to the projection 203, further raising the arc voltage and thus aiding the arc extinction. Furthermore, with the described form of the projection 203, even if the stationary-contactor contact 202 or the movable-contactor contact 302 wears, the projection 203, being lower than or equal to the height of the stationary-side contact 202, will not physically obstruct the contact between the contacts 202 and 302, enabling contact to be reliably made. Also, the arc A that has shifted to the projection 203 is subject to the confining effect discussed in the explanation of FIG. 5, such that the current limiting effect is, of course, continued.

As a means to further increase the effect of confining the arc A shifted to the projection 203, it is possible to construct the projection 203 with a smaller surface area than the stationary-contactor contact 202.

Figure 9:
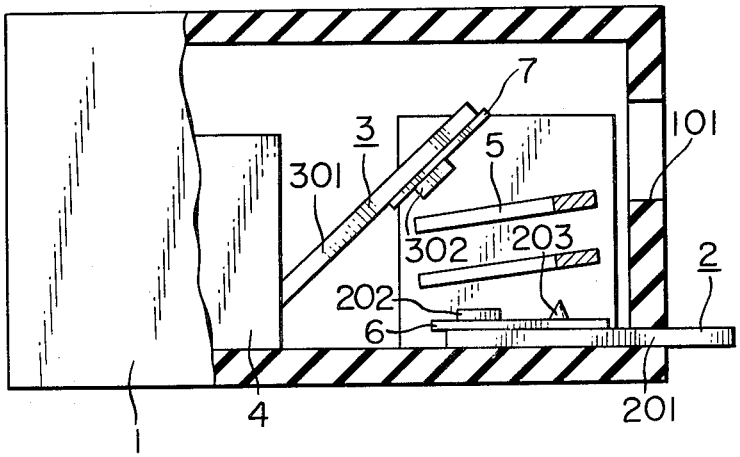
FIG. 9 is a sectional plan view showing another embodiment of a circuit breaker according to this invention.
Figure 10B:
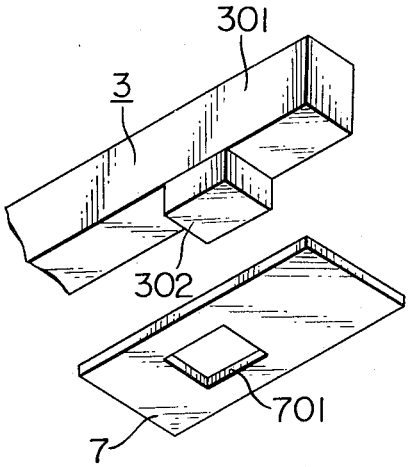
FIG. 10(*a*) is an exploded perspective view of the stationary contactor portion of the circuit breaker of FIG. 9.
Figure 10A:
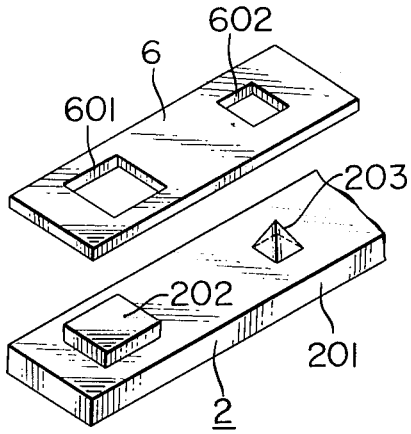

FIG. 9 illustrates another embodiment of the present invention wherein all parts and the construction thereof, with the exception of the projection 203, are substantially similar to the corresponding parts and construction of the embodiment shown in FIGS. 3(*a*) and 3(*b*). That is to say, a stationary-contactor contact 202 is mounted on an end portion of a stationary rigid conductor 201, and a substantially quadrilateral pyramid-shaped electrically conductive projection 203 is provided at the end of the stationary rigid conductor 201 in proximity to the stationary-contactor contact 202 on the side of the direction in which the arc flows, i.e. the side of the arc extinguishing plate assembly 5. Also, a movable-contactor contact 302 is mounted on an end portion of the movable rigid conductor 301. As shown in FIG. 10(*a*), the stationary-contactor contact 202 and the projection 203 respectively pass through through-holes 601 and 602 in the arc shield 6, and as shown in FIG. 10(*b*), the movable-contactor contact 302 passes through a through-hole 701 in the arc shield 7, the arc shields 6 and 7 being fixed respectively to the stationary and movable rigid conductors 201 and 301.

The basic operation of the circuit breaker of the embodiment shown in FIG. 9 is the same as that of the embodiment shown in FIG. 3(*a*) and 3(*b*), and so a description thereof is omitted. In this embodiment, the substantially quadrilateral pyramid-shaped electrically conductive projection 203 is mounted on the end of the stationary rigid conductor 201 in proximity to the stationary-side contact 202, so when an arc is drawn across the gap between the contacts 202 and 302, the foot of the arc on the stationary-contactor contact 202 can be easily shifted to the projection 203. That is to say, due to the facts that the arc voltage between the stationary-contactor contact 202 and the movable-contactor contact 302 is greatly raised by the effect of the arc shields 6 and 7, that the projection 203 is at the same potential as the stationary-contactor contact 202, and has a pointed tip such that a concentration of the electrical field occurs and the field strength becomes very great, and that the arc is located in a gas that is at high temperature and high ionization due to the arc, a dielectric breakdown occurs between the movable-contactor contact 302 and the projection 203 and the foot of the arc on the stationary-contactor contact 202 shifts to the projection 203. Accordingly wear of the stationary-contactor contact 202 is reduced, and contact between the arc and the arc extinguishing plate assembly 5 to extinguish the arc is more efficiently achieved.

Also, since the areas peripheral to the contacts are covered by the arc shields 6 and 7, the foot of the arc does not shift to the surfaces on which the contacts are mounted, and the rise in the temperature of the contacts is thus reduced, such that the contacts are not caused to fall off.

Figure 11B:
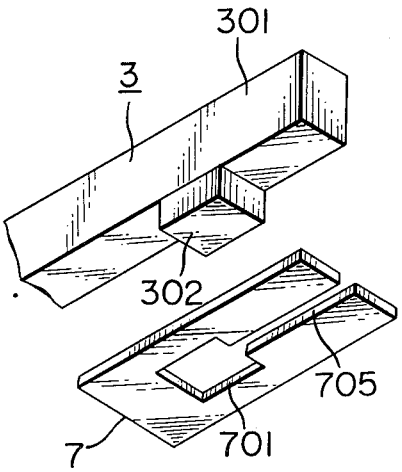
FIG. 11(*a*) is an exploded perspective view of a stationary contactor portion employing an embodiment of an arc shield different from that shown in FIG. 10(*a*)
Figure 11A:
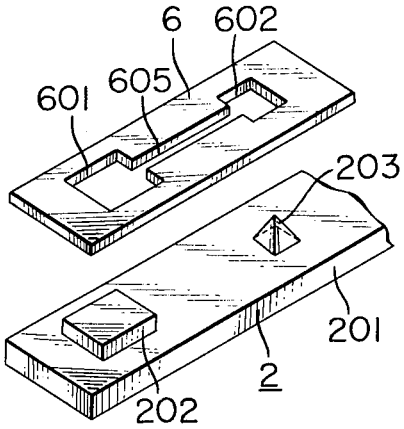

In this embodiment too, as shown in FIG. 11(*a*) a slit 605 can be provided in the arc shield 6 in such a manner as to expose the surface of the stationary rigid conductor 201, the slit 605 joining the respective through-holes 601 and 602 provided for the stationary-contactor contact 202 and the projection 203. Additionally, as shown in FIG. 11(*b*), a slit 705 is provided in the movable-contactor arc shield 7 extending from the movable-contactor contact 302 in the direction in which the arc travels, i.e. towards the arc extinguishing plate assembly 5, this slit 705 thus exposing a portion of the surface of the movable rigid conductor. These slits promote the travel of the arc.

Figure 12:
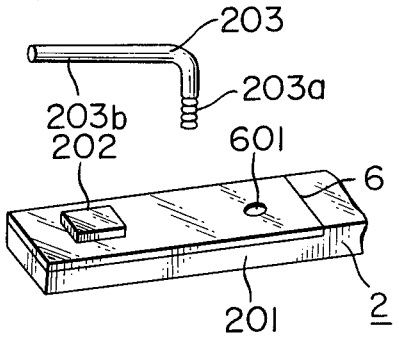
FIG. 12 is an exploded perspective view of a stationary contactor portion showing an embodiment wherein the projection provided in proximity to the stationary-contactor contact is a substantially L-shaped rod.

Next, another embodiment of the present invention is shown in FIG. 12 wherein a special type of projection 203 which is substantially different in form from the projections of the previously described embodiments hereinabove, is used. The particular form is intended to rapidly shift the arc drawn across the gap between the contacts to the projection to prevent wear of the stationary-contactor contact. In FIG. 12 an arc shield 6 is provided on the rigid conductor 201 of the stationary contactor 2 in a manner so as to surround the periphery of the stationary-contactor contact 202, as in the previous embodiments. Also provided is a projection 203 of a material of a higher conductivity than the arc shield 6, e.g. the same material as the rigid conductor 201, the projection 203 being formed as a substantially L-shaped cylindrical rod, with one end 203*a* threaded to allow threaded engagement with a threaded hole (not visible in the drawing) provided in the rigid conductor 201. The thus engaged L-shaped projection 203 has its one end 203*a* passing through a hole 601 in the arc shield 6 in mechanically rigid electrical contact with the rigid conductor 201. Thus, the rigid conductor and the projection 203 are at the same electrical potential. The other end 203*b* of the projection 203 is physically spaced from the rigid conductor 201 and the arc shield 6, and extends toward the stationary contact 202.

Figure 13A:
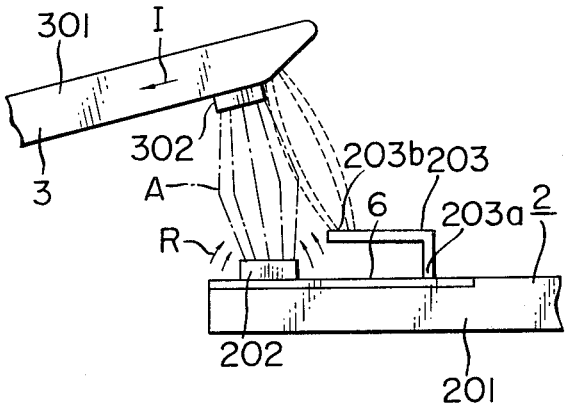
FIG. 13(*a*) is a diagram for showing the behaviour of an arc with a stationary contactor employing the L-shaped projection shown in FIG. 12.
Figure 13B:
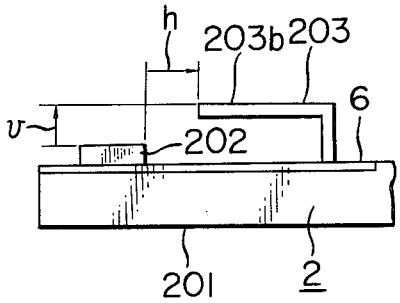

With a stationary contactor 2 of this construction, an arc A drawn across the gap between the contacts 202 and 302 is subject to the confining effect of the arc shield and is caused to contract in the direction shown by arrows R, as shown in FIG. 13(*a*), and the foot of the arc A is limited to the upper surface of the stationary-contactor contact 202, not increasing in size beyond the size of the surface area of the top of the stationary-contactor contact 202. Also, the metal particles emitted from the contact 202 possess directionality and are confined to the space of the arc A. Accordingly, as shown in FIG. 13(*b*), by suitably selecting the vertical and horizontal distances v and h from the contact 202 to the projection 203, a proportion of the metal particles is directly blown to the exposed end 203*b* of the projection 203, raising the temperature of the surface of the projection 203, to reach a surface temperature sufficient for the production of the foot of the arc.

In these circumstances, if the arc A is subjected to a magnetic force in the direction of the projection 203, it will immediately shift to the projection 203. The said magnetic force is produced by a magnetic field generated by the current I flowing in the movable rigid conductor 301 of FIG. 13(*a*). To ensure that the arc A shifts smoothly to the projection 203, a zero or positive value for v and a positive value for h, in FIG. 13(*b*), are suitable.

The effect of the arc shield 6 is not just to limit the size of the foot of the arc A of FIG. 13(*a*), and to regulate the direction of emission of metal particles from the stationary-side contact 202, for it also has the effect of preventing the arc A from travelling from the contact 202 to anywhere other than the projection 203, whereby the arc A is caused to travel reliably and rapidly to the projection. At this time, the exposed end 203*b* of the projection 203 being separated by a gap from the stationary rigid conductor 201, it is possible to provide an arc shield 6 under the exposed end 203*b* whereby the arc shield 6 fully surrounds the periphery of the contact 202, with the result that the effects of the arc shield 6 are effectively exhibited. In this way, the arc A is shifted to the projection 203 reliably and sooner than heretofore. On the other hand, the foot of the arc A on the movable-contactor contact 302, too, is, of course, drawn, and leaves the contact 302, and so by virtue of the provision of the projection 203, wear of the contacts 202 and 302 by the arc A is markedly reduced.

Figure 14A:
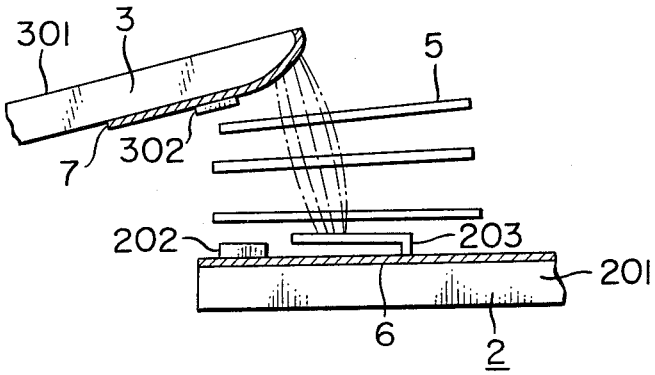
FIG. 14(*a*) is a diagram for showing the behaviour of an arc in an embodiment employing an arc shield on the movable contactor portion opposing the stationary contactor portion shown in FIG. 13(*a*)
Figure 14B:
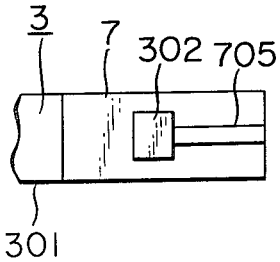

FIG. 14(*a*) shows another embodiment of the present invention wherein the device of FIGS. 13(*a*) and 13(*b*) has an arc shield 7 provided on the movable rigid conductor 301 as well. Further, a slit 705 is provided in the arc shield 7, as shown in FIG. 14(*b*), from the contact 302 towards the tip of the conductor 301, to expose the surface of the movable rigid conductor 301, whereby an arc runway of high conductivity is formed to facilitate the running of the arc. In this way, arc shields 6 and 7 are respectively provided on each of the contactors 2 and 3 to control the size of the feet of the arc A on the two contactors 2 and 3, whereby the metal particles emitted from the feet of the arc A on the contacts 202 and 302 are effectively injected into the arc positive column, and the arc is cooled by the metal particles, whereby the arc voltage is markedly raised and the current limiting performance is further raised. Immediately after the arc is produced, it is thus current-limited by the high arc voltage, and after a very short period of time, the foot of the arc A shifts to the projection 203, reducing wear on the contacts 202 and 302.

Figure 15A:
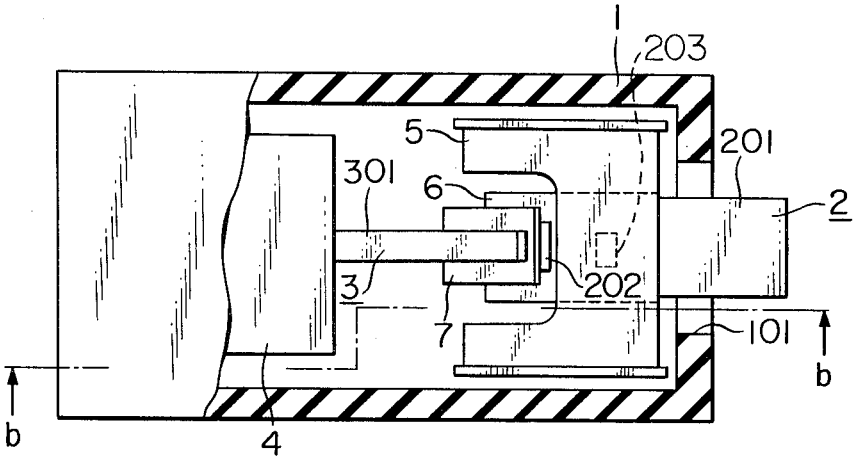
FIG. 15(*a*) is a sectional plan view showing another embodiment of a circuit breaker according to the present invention.
Figure 15B:
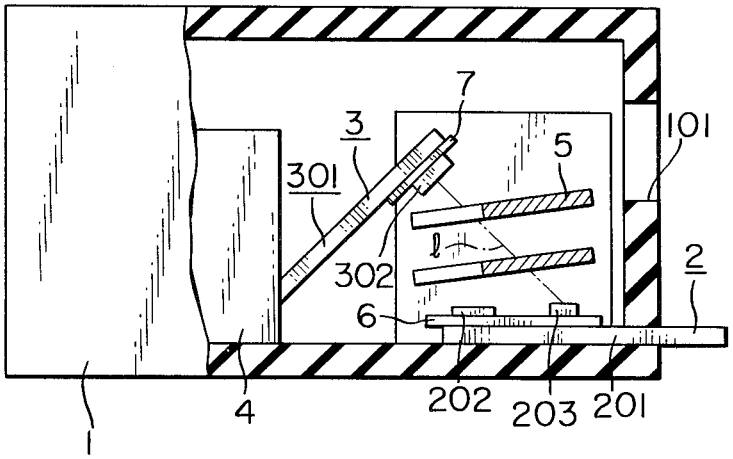

FIGS. 15(*a*) and 15(*b*) illustrate a further embodiment of the present invention which is constructed such that when the foot of the arc A drawn across the gap between the contacts 202 and 302, shifts to the projection 203, the arc makes contact with the arc extinguishing plate assembly 5, whereby the arc is effectively cooled. That is to say, in FIGS. 15*a* and 15*b*, a stationary-side contact 202 is affixed to a stationary rigid conductor 201, and an electrically conductive projection 203 is provided in proximity to the stationary-contactor contact 201 on the side to which the arc travels, i.e. the side of the arc extinguishing plate assembly 5. Also, a movable-contactor contact 302 is provided at the end portion of the movable rigid conductor 301. The positional relationship between the projection 203 and the arc extinguishing plate assembly 5 is such that a straight line l joining the projection 203 and the opposing movable contact 302 traverses a portion of the arc extinguishing plate assembly 5 within the cut-out portion.

Figure 16:
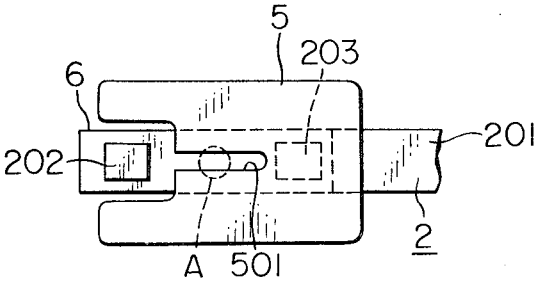
FIG. 16 is a plan view of an arc extinguishing plate assembly showing an embodiment provided with a narrow slit in the cut-out portion of the arc extinguishing plates above the stationary contactor.

This embodiment, similar to the preceeding embodiments, is provided with arc shields 6 and 7 respectively mounted to the rigid conductors 201 and 301, the arc shields 6 and 7 serving to raise the arc voltage by confining the arc drawn across the gap between the contacts 202 and 302. With the construction incorporating the above-described positional relationship between the projection 203 and the arc extinguishing plate assembly 5, when the foot of the arc A shifts to the projection 203, the arc A contacts the cut-out portion of the arc extinguishing plate assembly 5, whereby it is effectively cooled and extinguished. Further, the provision of a narrow slit 501 in the cut-out portion as shown in FIG. 16 allows sufficient contact with the arc A to further increase the effectiveness of the aforementioned cooling and extinguishing of the arc.

What is claimed is:

1. A circuit breaker with an arc restricting device, comprising a stationary contactor and a movable contactor, each contactor having a rigid conductor and a contact secured thereon; an electrically conductive projection mounted on and electrically connected to the conductor of at least one of said contactors in proximity to the contact thereon and on the side of the contact toward which an arc drawn across a gap between said contacts when said contacts separate for enabling the arc to shift from said contact to said projection; an arc shield of a high resistivity material having a resistivity higher than that of said rigid conductors disposed on said at least one contactor and surrounding the peripheries of the contact thereon and said projection; and an arc extinguishing plate assembly provided in the space between said contacts and on the side thereof toward which the arc will run for cooling and extinguishing said arc.

2. A circuit breaker as claimed in claim 1 wherein the height of said projection above said conductor is greater than the corresponding height of the contact on the same conductor for enabling the foot of the arc to shift easily from the contact to said projection.

3. A circuit breaker as claimed in claim 1 wherein the height of said projection above said conductor is less than the corresponding height of the contact on the same conductor for increasing the length of the arc when the foot of the arc shifts from said contact to said projection, thereby assisting the action of extinguishing said arc.

4. A circuit breaker as claimed in claim 1 wherein said projection is quadrilateral pyramid with a substantially pointed apex, whereby the foot of the arc is able to shift easily to said projection.

5. A circuit breaker as claimed in claim 1 wherein the projection is a substantially L-shaped rod member having one arm extending perpendicular to said conductor and the other arm extending parallel to said conductor from said one arm toward the contact, whereby the foot of said arc is able to shift easily to said projection.

6. A circuit breaker as claimed in claim 1 wherein said arc extinguishing plate assembly is disposed between said stationary and movable contactors and has cut-out portions in the plates thereof opening toward the contacts, said projection on said at least one of said conductors being spaced away from the contact on the same conductor such that a straight line joining said projection and the contact on the other conductor traverses the arc extinguishing cut-out portion of said arc extinguishing plate assembly.

7. A circuit breaker as claimed in claim 1 wherein said arc shield has a narrow slit therein extending from the contact on the contactor away from the contact in the direction the arc will run for enabling the arc to travel easily in the direction of said arc extinguishing plate assembly.

8. A circuit breaker as claimed in claim 1 wherein the surface area of said projection is smaller than the surface area of the contact on the same conductor for assisting the confining of the arc drawn across the gap between said contacts.

9. A circuit breaker as claimed in any one of the preceeding claims wherein said projection is on said stationary rigid conductor of said stationary contactor in proximity to the contactor contact on said stationary rigid contactor.

* * * * *